US005871124A

United States Patent [19]

Wilkinson

[11] Patent Number: 5,871,124

[45] Date of Patent: Feb. 16, 1999

[54] COMBINATION TOOTHPASTE DISPENSER AND TOOTHBRUSH HOLDER

[76] Inventor: William T. Wilkinson, P.O. Box 73, Salem, N.J. 08079

[21] Appl. No.: 888,269

[22] Filed: Jul. 3, 1997

[51] Int. Cl.[6] ..... B67D 1/07; B67D 5/06; B67D 5/22; B65D 35/28

[52] U.S. Cl. ..... 222/192; 222/47; 222/183; 222/95

[58] Field of Search ..... 222/192, 95, 183, 222/47, 41, 50

[56] References Cited

U.S. PATENT DOCUMENTS

| | | | |
|---|---|---|---|
| D. 267,060 | 11/1982 | Iwamoto | D23/2 |
| D. 308,475 | 6/1990 | Gastwirt | D9/337 |
| 3,861,640 | 1/1975 | Agneta | 249/102 |
| 4,010,870 | 3/1977 | Wilson | 222/95 |
| 4,705,194 | 11/1987 | Judge | 222/192 |
| 4,776,492 | 10/1988 | Gallo | 222/183 |
| 4,817,826 | 4/1989 | Judge | 222/192 |
| 4,955,567 | 9/1990 | Longhurst | 248/108 |
| 5,020,694 | 6/1991 | Pettengill | 222/137 |
| 5,271,527 | 12/1993 | Haber et al. | 222/47 |
| 5,289,949 | 3/1994 | Gentile | 222/137 |
| 5,482,095 | 1/1996 | De Chollet | 222/192 |
| 5,538,161 | 7/1996 | Koehler et al. | 222/47 |
| 5,638,840 | 6/1997 | Lee et al. | 132/310 |

*Primary Examiner*—Andres Kashnikow
*Assistant Examiner*—Keats Quinalty
*Attorney, Agent, or Firm*—Connolly & Hutz

[57] ABSTRACT

A combination dispenser and personal care tool device is in the form of a rigid container for a bathroom item. A retainer or holder is mounted to the container which receives a personal care tool. In a preferred practice of the invention the container is a toothpaste dispenser and the personal care tool is a toothbrush. In a further aspect of the invention the dispenser includes indicia for indicating the contents level in the dispenser.

25 Claims, 4 Drawing Sheets

14
20
30
12

26
46
42
30
30
44

66
10
68
10
10
50
62
12
14

12
62
64
50

74
70
72
76
50

88
86
50
50
84
82
80

COMBINATION TOOTHPASTE DISPENSER AND TOOTHBRUSH HOLDER

BACKGROUND OF THE INVENTION

There is often limited space in the bathroom, particularly on the counter/sink top. Clutter frequently results from including various personal care types of containers, such as toothpaste dispensers, mouthwash bottles, cups, glasses, hand cream/soap dispensers, shaving cream cans, tissue dispensers, soap dishes and even decorative items such as flower vases. In addition to such containers the bathroom area frequently includes tools or instruments which are used for applying or otherwise treating various parts of the user's body such as toothbrushes, razors, soap, nail files, combs, cotton swabs and other personal care tools.

It would also be desirable if a bathroom type dispenser, such as a toothpaste dispenser, could be provided with some manner of readily indicating when the contents of the dispenser have been completely used or is almost completely used to alert the user that it is time to replace the dispenser.

SUMMARY OF THE INVENTION

An object of this invention is to provide a combination container and personal care tool particularly intended for bathroom use which minimizes space requirements.

A further object of this invention is to provide such a combination which particularly lends itself to combining a toothpaste dispenser with a mouth applicating member, such as a toothbrush.

In accordance with this invention a dispenser in the form of a rigid container is provided for containing a bathroom item in the container. Such bathroom item may be toothpaste, soap, tissues, mouthwash, cream, flowers, etc. The container has a dispensing opening for the selective removal of the bathroom item. At least one personal care tool retainer is mounted to the container and a personal care tool or bathroom item is detachably mounted in the retainer for ready access and use.

In a preferred practice of the invention the rigid container is a toothpaste dispenser such as being of the pump type. The personal care tool is a mouth applicating member such as a toothbrush, gum massager, etc.

The retainer may be permanently attached to the container such as by being molded to the container. Alternatively, the retainer may be detachably mounted for use on other containers.

In accordance with a further embodiment of this invention indicia is provided on the dispenser in connection with the two moving parts such as the plunger and barrel of a pump type toothpaste dispenser to indicate the amount of material remaining in the dispenser. In a preferred practice of this aspect of the invention complementary indicia is provided on the barrel and plunger to form some definite indication of when the container is empty, such as by the completing of a circle which would represent the mouth of a caricature on the container or such as by completing of the letter E to indicate that the container is empty.

THE DRAWINGS

DETAILED DESCRIPTION

Figure 1:
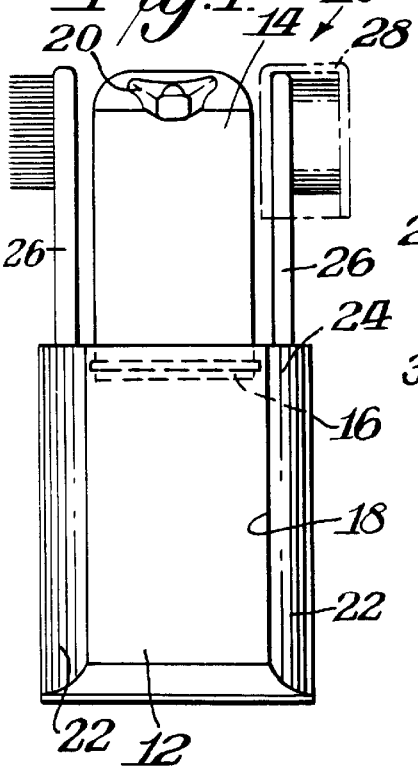
FIGS. 1–9 are elevational views of various combinations of containers and personal care tool retainers in accordance with this invention.

The present invention is related in one aspect to reducing clutter, promoting organization and creating convenient space saving storage. In another aspect of this invention a flowable material dispenser such as a toothpaste dispenser is provided with a level indicator to indicate the amount of flowable material content in the container and particularly to indicate when the dispenser is completely empty.

In accordance with the first aspect of this invention the combination container and personal care tool retainer has the advantageous function of permitting the storing of bathroom type items, such as cosmetic, shaving devices, toothbrushes, nail or hair instruments and other personal care tools, as well as decorative items such as flowers. In general, the invention could be practiced wherein a holder or retainer is combined with a container. The retainer can be a rack, stand or holder of any suitable design which can be a permanent part of or detachably mounted to the container. The container itself could take any suitable form commonly found in the bathroom and particularly on counter/sink tops. Such common forms of containers include toothpaste dispensers, particularly dispensers having rigid containers of the pump, tube or standup tube type. Other containers may be mouthwash bottles, hand cream/soap dispensers, shaving cream dispensers, tissue box/holders, soap dish/shampoo bottles or even cups/glasses and decorative items such as flower vases.

In a preferred embodiment of the invention one or more toothbrush and/or dental instrument holders or retainers is permanently incorporated or molded to the container which preferably is a toothpaste pump. The personal care tool itself is preferably a mouth applicating member such as a toothbrush or dental instrument (e.g. gum massager, flosser, pik,). If desired, the invention may be practiced by providing the container with a hook or bracket for attachment to a wall or shelf to further reduce clutter.

Preferably where the invention is practiced with the container being a toothpaste dispenser of the pump type, the pump is of a plunger/piston design having a side spout. The container may have a single or multiple chambers for containing the flowable materials such as toothpaste in each of the chambers for simultaneous dispensing from a common spout or for dispensing independently from individual spouts. The relationship between the piston and cylinder or barrel could be one where the top member is the barrel or cylinder which slides relatively downwardly over the inner rigid plunger by either moving the plunger upwardly or moving the barrel downwardly to contract the size of the container (and its flowable material chamber) and forcing the material through the spout. Alternatively, the upper member could be the plunger which slides into the rigid barrel. The contents could be located in either the top member or the bottom member or in the combined chamber formed by both members. Where the contents are in the bottom member, the added weight gives further stability.

The holders or retainers could be of any suitable design located at any suitable part of the container. Preferably the holders are mounted to the outer member (barrel). Various figures illustrate exemplary embodiments.

FIG. 1 shows a combination container personal care holder 10 in accordance with this invention wherein the container is a pump type toothpaste dispenser of the type shown and described in my co-pending application Ser. No. 08/783,956 filed Jan. 17, 1997, the details of which are incorporated herein by reference thereto. As shown in FIG. 1, the combination device includes a toothpaste dispenser in the form of a container having an outer rigid barrel 12 into which is slidably mounted an upper rigid plunger 14. When there is relative movement of the plunger into the barrel a piston head 16 makes sliding contact with the inner surface 18 of the barrel 12. (For clarity of illustration the piston head is illustrated as spaced from the inner surface.) This reduces or contracts the size of the chamber formed by the inner surfaces of the plunger and barrel so as to force the material through the dispensing spout or outlet 20.

Figures 7, 8, 9, 10, 11, 12:
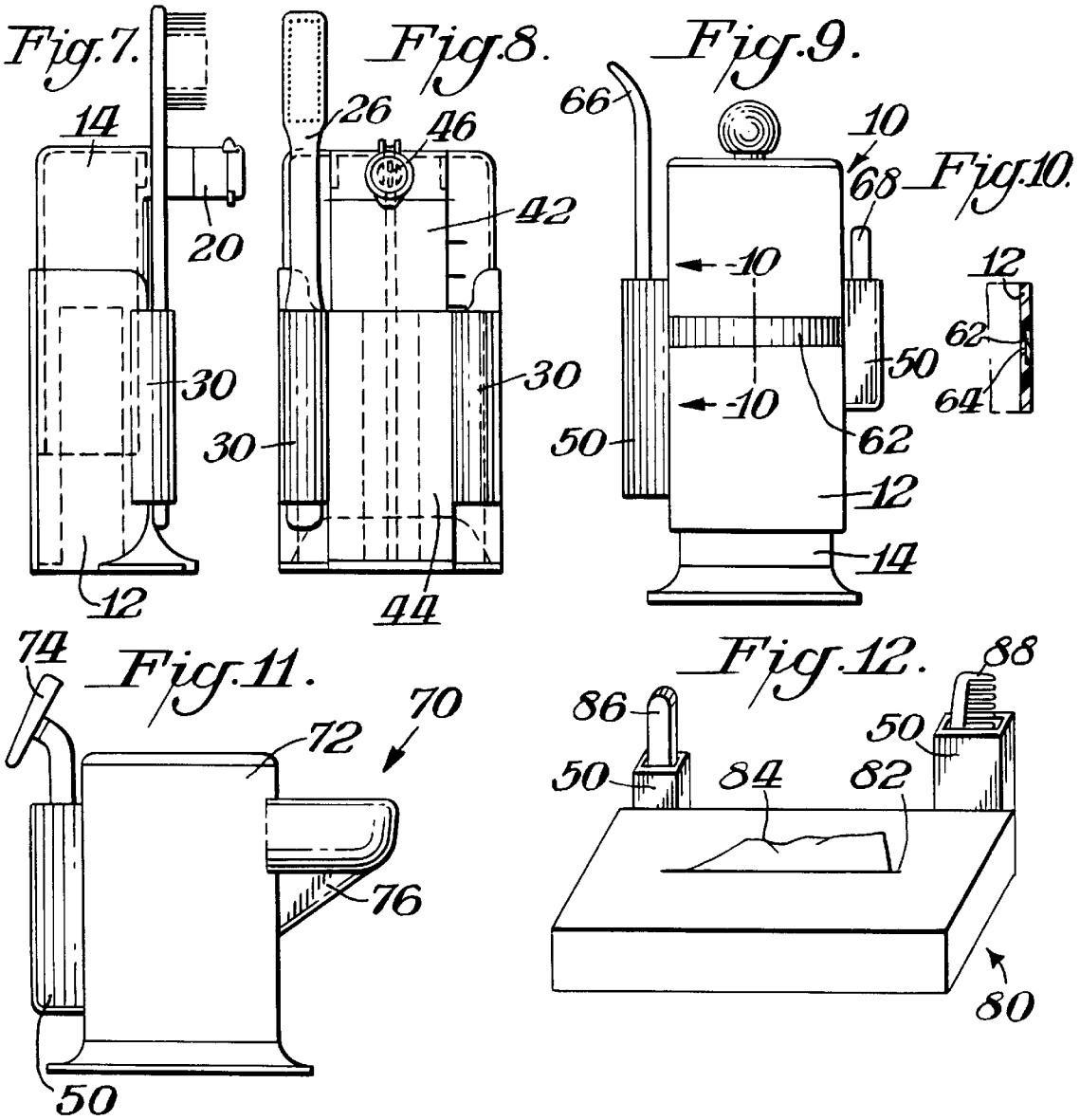
FIG. 10 is a cross-sectional view taken through FIG. 9 along line 10—10.
FIG. 11 is a side elevational view of a further embodiment of this invention.
FIG. 12 is a perspective views of an alternative combination container and personal care retainers in accordance with this invention.

In the embodiment shown in FIG. 1 a retainer 22 is formed at two diametrically opposite portions of the barrel 12 with the spout 20 being centrally therebetween. (As shown in FIGS. 7–8 the retainers are preferably at the front on each side of the spout.) The retainers 22 may take any suitable form. As illustrated the retainers 22 are integrally molded with the barrel 12 to form pockets having an open upper end 24 with the lower end being closed. As illustrated a toothbrush 26 is placed in each pocket. If desired, each toothbrush may have, for example, a sanitary cover 28 of known design. Similarly, a sanitary cover may be over spout 20. In use the rigid container would be self-mounting by the flared base of barrel 12 resting directly on, for example, a counter top or sink top. The user would remove one of the toothbrushes 26 and then dispense toothpaste directly on the toothbrush by pushing down on plunger 14.

An advantage of having retainer 22 permanently attached to the container is that it encourages a limited number of uses of the toothbrush in that a toothpaste manufacturer might market the toothpaste with the toothbrush provided as part of the original package. Thus, when a toothpaste dispenser is completely empty the user would throw away the old toothbrush and use a fresh toothbrush provided with the new dispenser.

Figure 2:
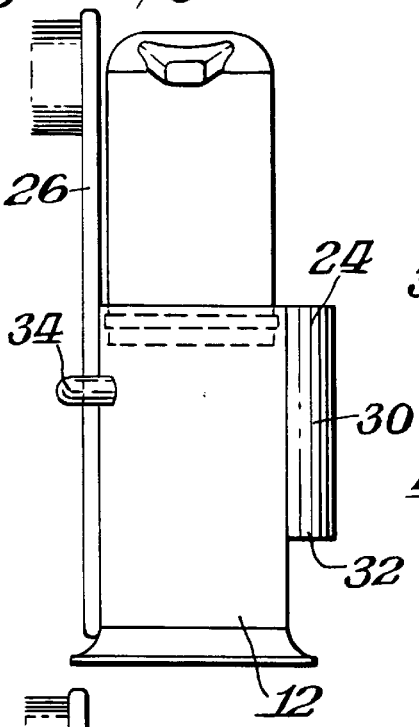

FIG. 2 shows variations in retainers. As illustrated therein a retainer 30 is integrally molded with barrel 12 in the form of a pocket having an open top 24 and an open bottom 32. An alternative form of retainer or holder 34 is illustrated which is a ring or U-type member into which the toothbrush 26 would be inserted until the toothbrush reaches the outwardly flared base of barrel 12 or reaches the counter top.

Figure 3:
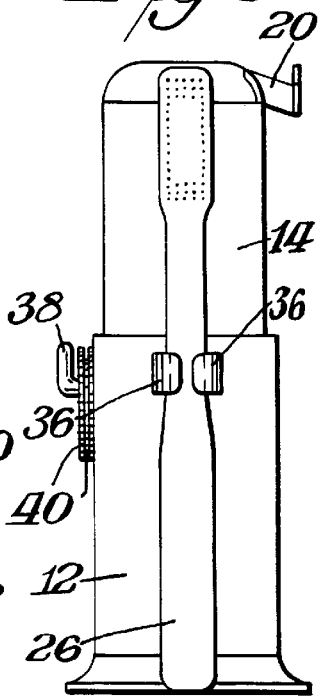

FIG. 3 illustrates a further variation in types of retainers. For example, a spring clip 36 is illustrated to detachably hold the toothbrush 26. FIG. 3 also illustrates a hook 38 integrally formed on barrel 12. Hook 38 is useful for holding other types of personal care tools such as a floss dispenser 40.

Figure 4:
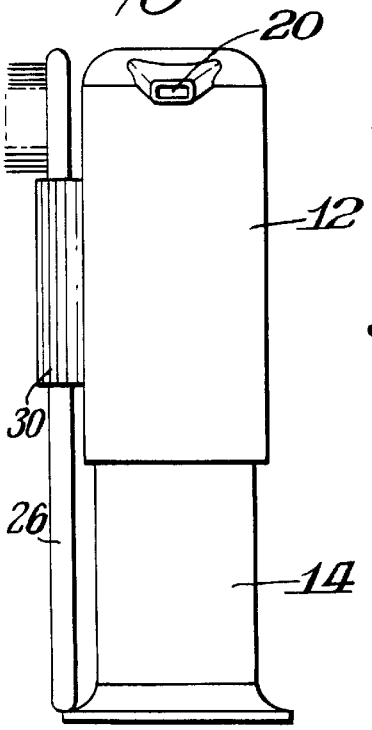
Figure 5:
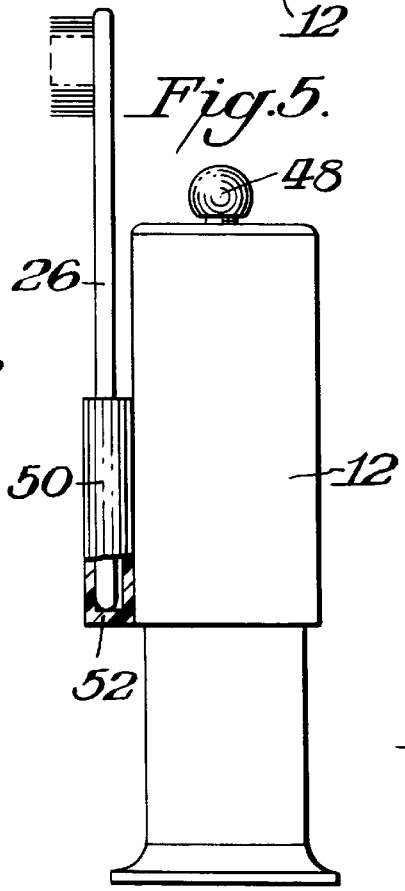
Figure 6:
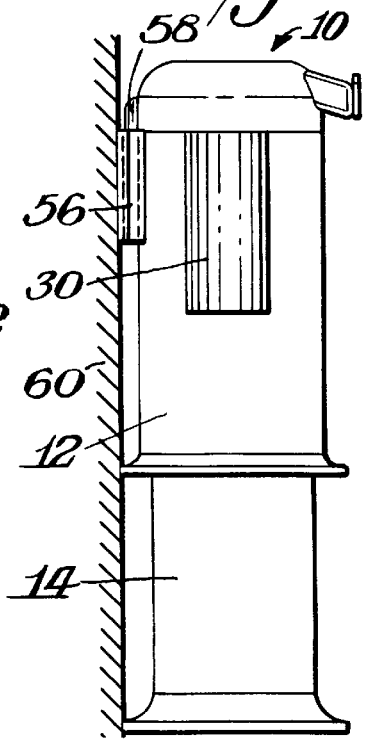

FIGS. 4–6 illustrate an alternative form of dispenser wherein the lower member is a rigid pump or plunger 14 with the upper member being the barrel 12. It is preferred in the various embodiments to mount the retainer to the outer member or barrel whether the barrel is the upper member or the lower member. Thus, FIG. 4 shows a retainer 30 similar to the retainer of FIG. 2 centrally located on the barrel 12.

FIG. 5 illustrates a variation of dispenser wherein the spout 48 is a top spout. The retainer or holder 50 mounted to the lower end of barrel 12 is shown as having a closed bottom 52.

The embodiments of the invention shown in FIGS. 1–5 illustrate the dispenser to be structured for being self-supporting in the sense of being placed directly on a counter top or sink top. The invention may also be practiced as shown in FIG. 6 where the combination container and personal care tool holder is mounted to a wall 60 or shelf so as to even further reduce the taking up of counter top space. FIG. 6 exemplifies one manner of mounting wherein a wall bracket 56 is provided into which a hook 58 would be inserted. Hook 58 is preferably integral with barrel 12. Any other type of detachable mounting could be used for securing the device 10 to a support such as wall 60.

FIGS. 7–8 illustrate a variation of the invention which represents a preferred location for the containers. As shown therein the spout 20 is located on the front side or face of the container. The retainers or holders 30 are located on the same side with each retainer being on an opposite side of spout 20. This minimizes space requirements because the retainer and personal care tools, such as toothbrush 26 would be located where the spout 20 is located and is extending forwardly of the container. This is the preferred location for such retainers. It is also preferred to either use a closed bottom retainer, such as retainer 50, or where the retainer has an open bottom, such as retainer 30 that the tool 26 does not extend completely to the counter top and thus, for example, extends only to the flared base of the lower member which is illustrated in FIGS. 7–8 as being the barrel 12.

FIGS. 7–8 also illustrate the dispenser to contain a plurality of chambers 42 in the plunger 14, each of which slides into a chamber 44 in the barrel for holding two different types of materials. The materials would be dispensed through spout 20 from individual streams by having a partition 46 in spout 20. Such type of dispenser is marketed under the name MENTADENT®. An alternative would be to have the multiple materials mix either before or during dispensing from the spout wherein the partition 46 would be omitted.

Although in the preferred practice of the invention the retainer or holder is permanently mounted to the container, the invention may be practiced with a detachable retainer. FIGS. 9–10, for example, illustrate a pair of retainers 50,50 connected to each other by being mounted to a resilient ring 62. Ring 62 would be stretched over barrel 12 and held in place by its resiliency. If desired, barrel 12 may have a preformed groove 64 for receiving ring 62. Thus, ring 62 would be snapped into groove 64. Other forms of detachable mounting may also be used such as non-resilient straps having free ends detachably secured together.

FIG. 9 also illustrates how personal care tools other than toothbrushes could be mounted in the retainer. For example, one retainer 50 includes a dental instrument such as a gum massager 66 while the other retainer includes dental floss 68.

The various embodiments shown in FIGS. 1–10 illustrate a toothpaste dispenser which could be of any suitable construction, including but not limited to the type of dispenser shown in U.S. Pat. No. 5,092,496 the details of which are incorporated herein by reference thereto. The invention may also be practiced with a dispenser such as a toothpaste dispenser in the form of a standup holder. With such type of dispenser the toothpaste is held in a non-rigid squeeze tube having a large rigid cap over the dispensing opening. In its storage condition the tube would be inverted so that the cap acts as a support. The invention would be practiced by incorporating one or more holders on the rigid cap to hold toothbrushes or other types of health care items. In such practice of the invention the rigid cap would be considered a portion of the container.

It is to be understood that the bathroom type container may take other forms such as previously noted for dispensing various other personal care items, such as shaving cream, hand cream, etc. FIG. 11 illustrates a variation of the invention wherein the device 70 is in the form of a cup or glass or vase having an open end 72 into which various materials would be inserted such as mouthwash, water, or even flowers where the device 70 is intended for aesthetic purposes. Holder 50 is shown to contain a razor 74. An additional holder 76 is provided which would function as a soap dish.

FIG. 12 shows a further variation of the invention wherein the device 80 is a tissue dispenser or holder of rigid form and may be of any suitable known shape and construction such as by including a dispensing slit 82 from which tissues 84 would be dispensed. Holders, such as holders 50 could be located at any suitable locations on the container. FIG. 12 also illustrates other types of personal care tools, such as a nail file 86 and a comb 88.

Figure 13:
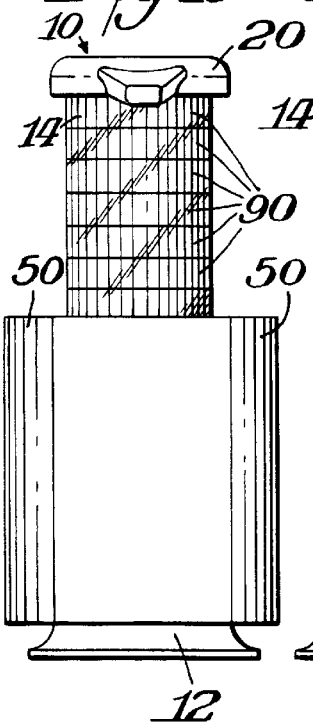
FIGS. 13–15 are elevational views of various embodiments of dispensers in accordance with a further aspect of this invention.

FIGS. 13–21 illustrate another aspect of this invention which may be used in combination with or independently of the aspect of the invention shown in FIGS. 1–12. The various embodiments of FIGS. 13–21 relate to providing some indicator of the amount of contents in a dispenser. Such dispenser is preferably of the plunger/barrel type as previously described. This aspect of the invention is based upon some form of indicia on either the barrel or piston which cooperates with the other member to give some indication of the amount of content left in the dispenser. Preferably indicia is provided on at least the plunger. As shown in FIG. 13 the plunger 14 is color coded. This may be accomplished by discrete bands 90 of different colors or by having the color gradually change from, for example, a deep color to a pale or white or vice versa as the plunger 14 moves more into the barrel 12.

Variations of color indicators could be to have the barrel 12 of one color, such as black with the spout and portions of the plunger 14 above the spout, also black and with the remainder of the plunger white. Thus, as the plunger is moved to its fully inserted position the amount of white showing would diminish and ultimately when in the fully dispensed condition only black would show.

A further color variation might be to have a wide green band visible on the plunger 14 when the dispenser is in its full or near full condition followed by a yellow band when the dispenser approaches an empty condition and finally a narrow red band when the dispenser is empty.

Figure 14:
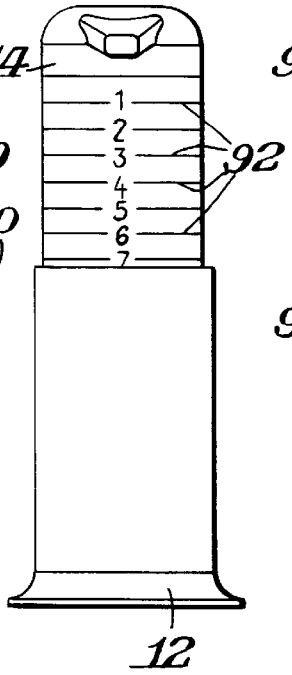

FIG. 14 illustrates a variation wherein stripes or lines 92 are provided in addition to numbers, for example, which might indicate the amount of ounces remaining in the dispenser. Other forms of indicia could be provided such a letters or fractions to indicate one quarter, one half, three quarters full. Any alphanumeric system may be used with or without stripes 92.

Figure 15:
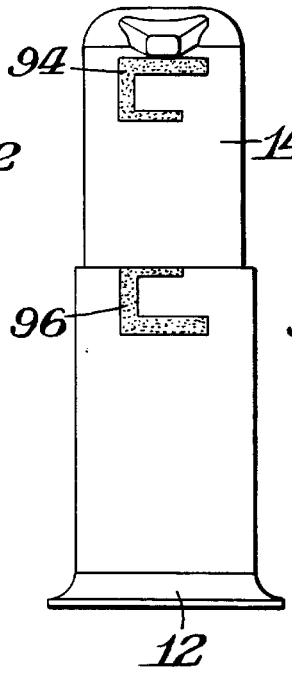
Figure 16:
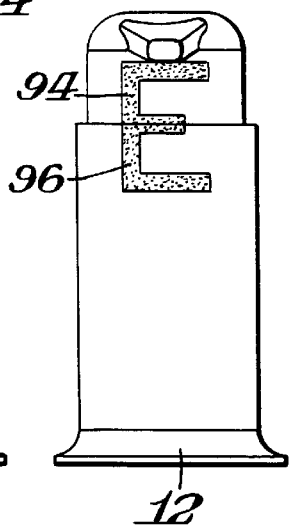
FIG. 16 is a view similar to FIG. 15 showing the dispenser of FIG. 15 in the empty condition.

FIGS. 15–16 show a particularly advantageous form of the invention wherein complementary indicia is used on both the barrel 12 and plunger 14 to indicate when the dispenser is empty. As illustrated, the indicia 94 on plunger 14 and the indicia 96 on barrel 12 are each part of the letter E. Thus, when the dispenser is empty, the two indicia 94 and 96 meet to display the completed letter E.

Figure 17:
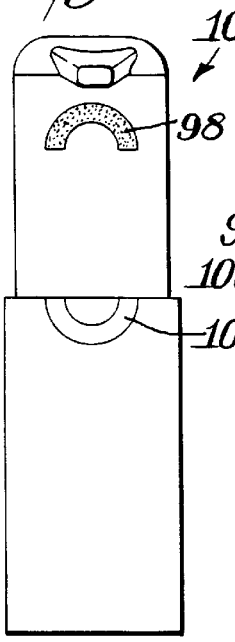
FIGS. 17–18 are elevational views showing an alternative container in positions wherein the container is full and is empty, respectively.
Figure 18:
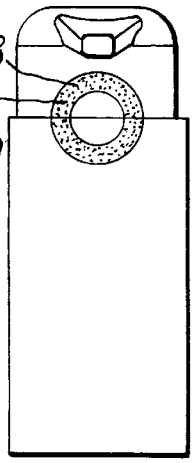

FIGS. 17–18 illustrate a variation wherein the complementary indicia 98, 100 are spread far apart when the dispenser is full but form the letter O when the dispenser is empty.

Figure 19:
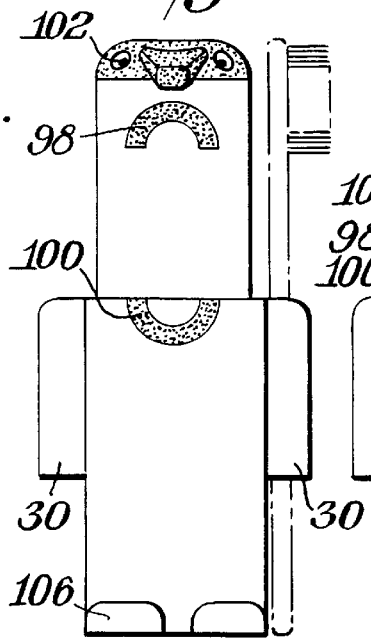
FIGS. 19–20 are elevational views of still yet a further alternative form of this invention showing the dispenser in full and empty conditions, respectively.
Figure 20:
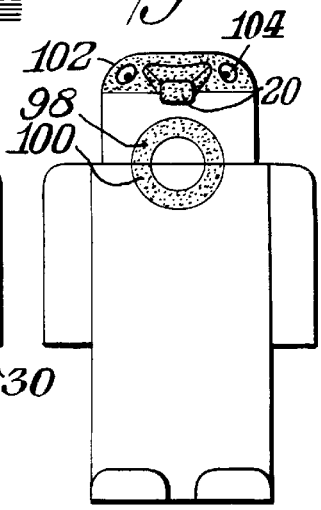
Figure 21:
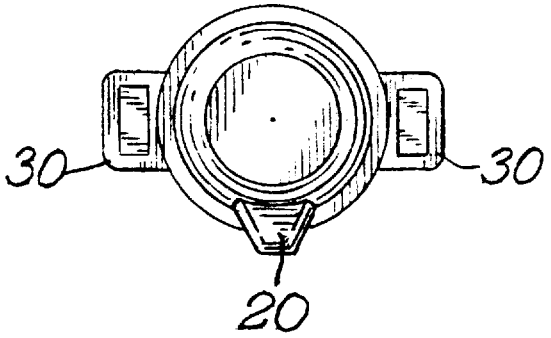
FIG. 21 is a top plan view of the various dispensers shown in FIGS. 13–20 in combination with a personal care tool retainer in accordance with this invention.

FIGS. 19–20 show a variation of the embodiment of FIGS. 17–18 wherein the plunger includes ornamentation to depict a caricature 102 so that the closed letter O formed by indicia 98, 100 forms the mouth of the caricature. As illustrated, the spout 20 would represent the nose, while eyes 104 and feet 106 would be formed on the caricature.

It is to be understood that the various forms of indicia illustrated in FIGS. 13–20 are merely exemplary. Thus the invention could be practiced using various types of numbers, letters, words, pictures, characters, faces, symbols, etc. Colors and designs may be used separately or in combination. The advantages of having a contents level indicator include the following:

1. The use of colors/designs emphasize the two basic components, i.e. top and bottom and/or barrel or plunger, thus better communicating the function of the dispenser as being a pump.

2. The manufacturer can select color/designs which are distinctive, thus creating a unique product market identity and recognition factor.

3. Colors and designs stand out more on a shelf in a store helping to attract and hold the buyer's eye/attention.

4. The colors and designs are attractive thus having decorative appeal. They can be used to create a set of designs or colors for a collection. Making a collectable item out of the device would be a good marketing strategy thereby increasing the desire of the consumer to buy more devices.

5. Because of the attractive appearance the pump or device can be clear wrapped, shrink wrapped and a cheaper package thus used.

6. Colors and designs can also be used as an indicator of the level of product or how full the pump is to alert the user of when it is getting time to buy a replacement.

It is to be understood that various features shown in specific embodiments may be used in other embodiments within the spirit of this invention. In particular, the aspect of the invention relating to holders or retainers for personal care items may be used with dispensers having some contents level indicator.

What is claimed is:

1. In a dispenser for bathroom use comprising a container, a bathroom item in said container, and said container having a dispensing opening for the selective removal of said bathroom item from said container, said container has a rigid barrel with at least one flowable material containing chamber defined by an inner surface of said barrel, and a plunger in said chamber having a piston head in contact with said inner surface of said barrel to force said material in said chamber through a dispensing spout communicating with said chamber as a result of relative movement of said piston head with respect to said inner surface of said barrel to thereby reduce the size of said chamber, the improvement being in that at least one personal care tool retainer being integrally mounted to said rigid barrel of said container externally of said container, and a personal care tool removably mounted in said retainer in a generally upright position for ready access and use by the user independently of the removal of said bathroom item from said container.

2. The dispenser of claim 1 wherein said retainer is in the form of an elongated vertically disposed pocket having an open top.

3. The dispenser of claim 2 wherein said pocket has a closed bottom.

4. The dispenser of claim 2 wherein said pocket has an open bottom.

5. The dispenser of claim 1 wherein said barrel comprises a lower member, and said plunger comprises an upper member.

6. The dispenser of claim 5 wherein each of said barrel and said plunger includes a front surface, said spout being located on said front surface, and said at least one retainer comprising a retainer on each side of said spout at said front surface of said barrel.

7. The dispenser of claim 6 wherein said barrel and said plunger contain multiple flowable material containing chambers, and said spout comprises a partitioned spout in communication with said multiple chambers.

8. The dispenser of claim 1 wherein said barrel comprises an upper member, and said plunger comprising a lower member.

9. The dispenser of claim 1 wherein said personal care tool is a mouth applicating tool.

10. The dispenser of claim 9 wherein said mouth applicating tool is a toothbrush.

11. The dispenser of claim 1 including mounting structure on said barrel for removably attaching said dispenser to a support surface.

12. The dispenser of claim 1 including level indicating indicia on at least said plunger.

13. In a rigid dispenser for flowable materials comprising a container having a rigid barrel with at least one flowable material containing chamber defined by an inner surface of said barrel, a plunger slidably mounted in said barrel, said plunger having a piston head in contact with said inner surface of said barrel to control the size of said chamber and to force the flowable material in said chamber through a dispensing spout communicating with said chamber as a result of relative movement of said piston head with respect to said inner surface of said barrel to reduce the size of said chamber, the improvement being in content level indicator structure on at least said plunger visible on the outer surface of said plunger to provide indicia for indicating the amount of flowable material in said chamber, said structure comprising structure on said barrel, complementary structure on said plunger, and said structure and complementary structure gradually move toward each other during use for forming a closed symbol when said structure on said barrel is juxtaposed to said complementary structure on said plunger under conditions of said chamber being substantially empty.

14. The dispenser of claim 13 wherein said symbol is the letter E.

15. The dispenser of claim 13 wherein said symbol is the letter O.

16. The dispenser of claim 15 including a caricature on said plunger, and said letter O forming the mouth of said caricature.

17. The dispenser of claim 16 wherein said spout is the nose of said caricature.

18. In a rigid dispenser for flowable materials comprising a container having a rigid barrel with at least one flowable material containing chamber defined by an inner surface of said barrel, a rigid plunger slidably mounted in said barrel, said plunger having a piston head in contact with said inner surface of said barrel to control the size of said chamber and to force the flowable material in said chamber through a dispensing spout communicating with said chamber as a result of relative movement of said piston head with respect to said inner surface of said barrel to reduce the size of said chamber, the improvement being in that at least one personal care tool retainer is mounted to one of said plunger and said barrel at a location remote from said dispensing spout with an open space between said retainer and said dispensing spout, a toothbrush detachably mounted in said retainer in an upright position, said toothbrush having a brush end near said dispensing spout and an elongated handle in said retainer, and a portion of said handle being in said open space to permit removal of said toothbrush from said retainer by grasping said portion of said handle in said open space below said spout and above said retainer.

19. The dispenser of claim 18 wherein a plurality of retainers are mounted to said container with a personal care tool in each of said retainers, one of said tools being said toothbrush, and another of said tools being a dental instrument other than a toothbrush.

20. The dispenser of claim 18 wherein said at least one retainer is mounted to said rigid barrel.

21. The dispenser of claim 18 wherein said retainer is detachably mounted to said barrel.

22. The dispenser of claim 18 wherein said retainer is integrally mounted to said barrel.

23. The dispenser of claim 20 wherein said retainer is in the form of a ring.

24. The dispenser of claim 20 wherein said retainer is in the form of a spring clip.

25. In a dispenser in the form of a container having a rigid barrel with at least one flowable material containing chamber defined by an inner surface of said barrel, a plunger in said chamber having a piston head in contact with said inner surface of said barrel to force said material in said chamber through a dispensing spout communicating with said chamber as a result of relative movement of said piston head with respect to said inner surface of said barrel to thereby reduce the size of said chamber, and a rigid cap detachably mounted over said dispensing spout, the improvement being in at least one personal care tool retainer integrally mounted to said rigid cap, and a personal care tool removably mounted in said retainer.

* * * * *